US005199116A

United States Patent [19]

Fischer

[11] Patent Number: 5,199,116

[45] Date of Patent: Apr. 6, 1993

[54] HIGH-EFFICIENCY PORTABLE SPA

[76] Inventor: Earl L. Fischer, 3708 Lehman Ct., Rogers, Ark. 72756

[21] Appl. No.: 698,290

[22] Filed: May 10, 1991

[51] Int. Cl.[5] ..... E03C 1/044

[52] U.S. Cl. ..... 4/541.2; 73/202.5

[58] Field of Search ..... 4/541, 542, 543, 544, 4/541.1, 541.2, 541.3, 541.4, 541.5, 541.6; 73/202.5, 204.21; 138/44

[56] References Cited

U.S. PATENT DOCUMENTS

| | | | |
|---|---|---|---|
| 2,543,588 | 2/1951 | Nelson | 73/204.21 X |
| 2,734,459 | 2/1956 | Zimsky | 103/87 |
| 3,228,851 | 1/1966 | Lemaitre et al. | 138/44 X |
| 3,734,811 | 5/1973 | Small et al. | 161/37 |
| 3,943,580 | 3/1976 | Carter | 4/172.15 |
| 3,970,210 | 7/1976 | Katsuta | 220/92 LG |
| 4,546,900 | 10/1985 | Lackey | 220/453 |
| 4,699,288 | 10/1987 | Mohan | 220/3 |
| 4,780,917 | 11/1988 | Hancock | 9/544 X |
| 4,843,659 | 7/1989 | Popovich et al. | 4/542 |
| 4,858,254 | 8/1989 | Popovich et al. | 4/544 X |
| 4,981,543 | 1/1991 | Popovich et al. | 156/191 |
| 5,092,951 | 3/1992 | Popovich et al. | 4/541.1 X |

OTHER PUBLICATIONS

Leaflet entitled "Affordaportarelaxafun" by Future Industries USA, Inc. of Wayne, N.J. (undated).

*Primary Examiner*—Henry J. Recla
*Assistant Examiner*—C. R. Eloshway
*Attorney, Agent, or Firm*—Hovey, Williams, Timmons & Collins

[57] ABSTRACT

A high-efficiency portable spa is provided for therapeutic and recreational use which includes a tub, a flow generator for circulating water in the tub, and a two-section insulating cover. A heat generator is located adjacent an outlet of the flow generator uses a constriction member in a fluid passageway to frictionally generate heat from the passage of fluid therein and also to reintroduce water circulating through a heat scavenging coil surrounding the flow generator. The tube is advantageously provided with a shell, a frame for supporting the shell, a flexible web barrier surrounding the frame, a skirt surrounding the web, and insulating foam which adheres to the web barrier so that, during curing, the skirt is isolated from shrinkage, crinkling or warping. The cover is provided in two sections and hinged therebetween. The edge of the cover rests on the shell of the tub, and one of the sections may be folded out of the way to provide access to the tub while substantially insulating the remainder.

6 Claims, 3 Drawing Sheets

HIGH-EFFICIENCY PORTABLE SPA

BACKGROUND OF THE INVENTION

1. Field of the Invention

This invention relates to a portable spa which is lightweight, thermally insulated, and uses a minimum of energy to heat the water circulated therethrough. The spa hereof uses a heat generating member to frictionally generate heat by the flow of water therethrough, a novel tub construction which preserves the external appearance of the tub while utilizing economical foam insulation, and employs a lightweight hinged cover to allow a portion of the spa to remain covered during limited occupancy.

2. Description of the Prior Art

Heated, circulating water has long been recognized for its relaxing, therapeutic effects on bathers. Many resorts were established in the 1800's near natural hot springs where bathers gathered to relax. In recent years the use of "hot tubs", in-ground spas, and portable spas have enjoyed great popularity as the benefits of heated circulating water have been made more affordable for the average citizen.

Some of the spas now available to the public are sold as "portable" spas in that they are constructed above ground so as to require no plumbing and excavation and can be supported by an outdoor deck or the like. Such spas are portable in the sense that they can be moved, but are nonetheless quite heavy (usually in the range of 400 to 600 pounds) and may include water circulation equipment internal thereto which can be dislodged or loosened during movement. Others require high voltage (220 vAC) current to operate, which is not always conveniently located in the American home.

Because the water in the tub of the spa is to be heated to about 100° to 105° Fahrenheit, energy efficiency is a prime concern. To the extent that the rate of heat loss may be minimized through insulation, less energy need be expended in heating the water. To this end, spas have been insulated on the normally underneath side in an effort to retain as much heat as possible in the water in the tub. Such insulation is shown, for example in U.S. Pat. No. 4,843,659 to Popovich et al., which discloses a foamed plastic sheet wound in a spiral. Such a manufacturing process is relatively labor and material intensive.

Thermal loss may also be avoided on the top of the tub by placing a cover thereover. Covers have been developed for this purpose. For example, a 6 inch foam insulated cover is offered by Future Industries USA, Inc. of Wayne, N.J. . However, this cover is of unitary construction and must be completely removed when the tub is in use by even a single occupant. Accordingly, a need has developed for a spa cover which can cover at least part of the tub when the spa is not fully occupied.

Finally, during start-up and periodically thereafter, some means for heating the water circulating through the tub must be provided. These heating devices may include resistance heaters or even gas or wood fired units. U.S. Pat. No. 4,893,659 shows a heat scavenging coil which collects waste heat from the pump motor and transfers the heat to the circulating water. However, it has been found that while use of this waste heat is advantageous, this source alone is generally insufficient to rapidly and economically warm the water within the tub.

Accordingly, there has developed a need for a lightweight, economical, and energy-efficient portable spa which is practical to use and easy to manufacture.

SUMMARY OF THE INVENTION

These problems have largely been solved by the energy-efficient spa of the present invention. That is to say, the spa hereof is lightweight and readily transportable when empty. The tub of the spa of the present invention weighs only about 150 pounds when empty and will roll through a doorway such that one person can readily handle movement of the spa. In addition, the spa hereof is thoroughly insulated from the top and bottom, and designed to make maximum use of heat sources which minimize any safety risks to the occupant.

The spa hereof frictionally generates a principal amount of the heat necessary to bring the water to the desired operating temperature from a novel water passageway including a constriction member for creating turbulence in a passageway and defining a surrounding flow path. Water circulating around the constriction member is forced to increase in velocity and the resulting turbulence and friction between the water in the flow path defined by the surrounding structure of the passageway and the constriction member generates heat in the water which is subsequently convected into the tub. In addition, the design of the constriction member and the surrounding structure creates a venturi which draws water through a coil surrounding the pump motor thereby providing an additional source of heat which would otherwise be wasted. The coil and the structure defining the passageway, as well as the remainder of the spa in contact with the circulating water, is preferably of synthetic resin material enabling the user to add minerals such as salt to the water in the tub without causing corrosion to the spa components.

The wall of the spa is additionally of novel construction, in that expandable synthetic resin foam may be adhered to the underside of the tub without fear of crinkling or warping of the surrounding synthetic resin skirt when the foam shrinks during curing. A flexible web barrier made out of an economical material such as paper serves to isolate the skirt from the foam, whereby a thin skirt presents an attractive appearance unaffected by the shrinking of the foam insulation. By using sprayable foam insulation, substantially the entire underneath surface of the tub may be insulated, and the foam insulation may be quickly and economically applied.

The cover of the spa hereof is advantageously constructed to present a first larger (⅔) section and a second smaller (⅓) section hingedly connected. Each section includes an arcuate edge wall whereby the cover may rest upon and wedge into the shell of the tub. Because the cover is hinged, one or two occupants may simply fold back the smaller section of the cover to gain entry while the remainder of the spa remains insulated. The two-section cover thus makes the spa more energy efficient as less heat need be applied to the water because less heat is lost to the atmosphere.

DESCRIPTION OF THE PREFERRED EMBODIMENT

Figures 1, 2:
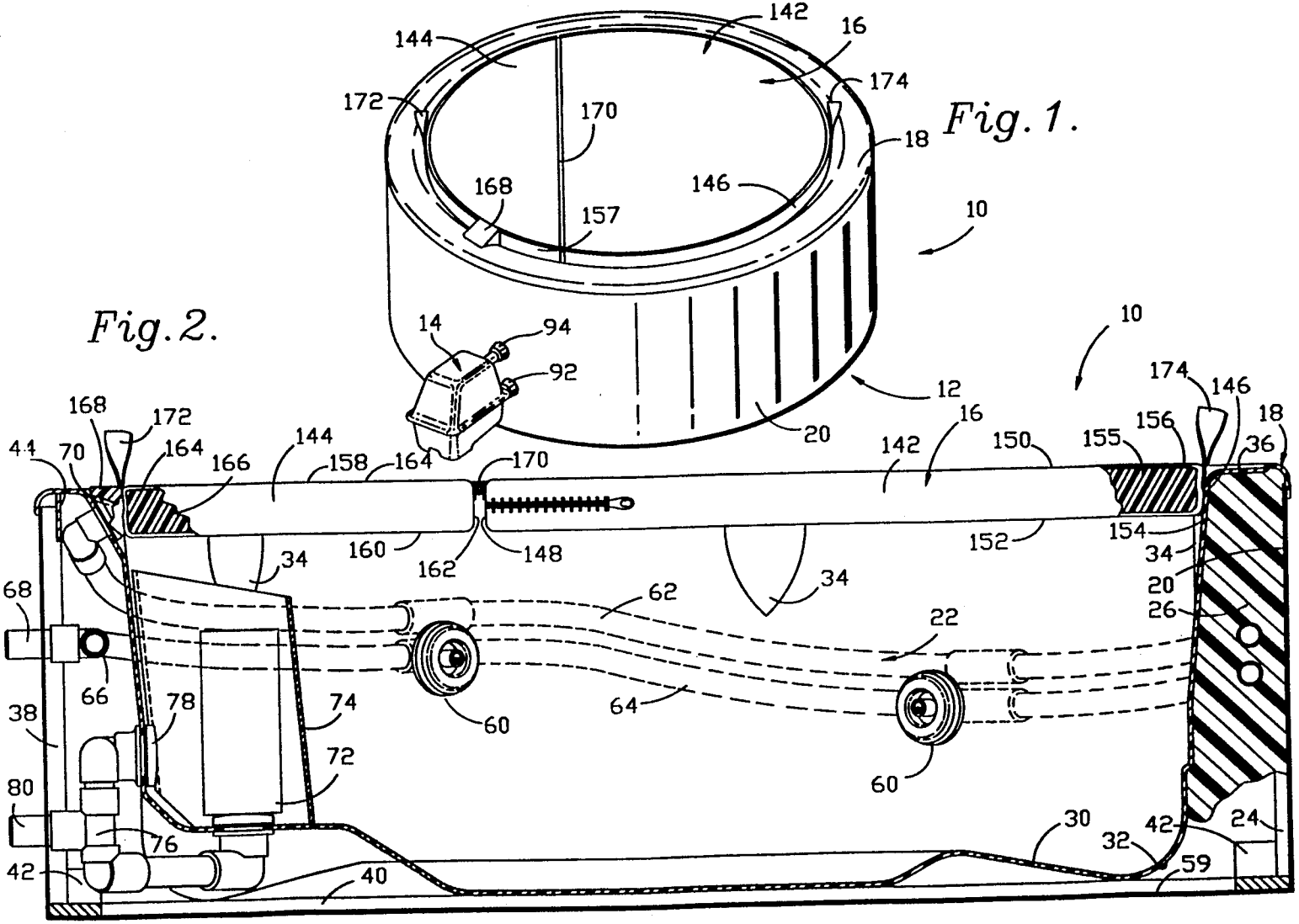
FIG. 1 is a perspective view of the spa of the present invention showing a power unit thereof connected to a tub, and showing a sectioned insulating cover over the tub.
FIG. 2 is a vertical cross-sectional view showing the tub construction with a portion of the insulating foam removed for clarity, and the insulating cover positioned thereon.

Referring now to the drawing, a high-efficiency portable spa is broadly designated by the reference character 10 in FIG. 1 and includes a tub 12, a power unit 14 and an insulating cover 16. The power unit 14 is detachably mounted to the tub 12 whereby when the tub is empty, the power unit 14 and tub 12 may be separately transported. The spa 10 hereof is thus truly transportable inasmuch as each of the components can be carried separately.

In greater detail, tub 12 includes a molded synthetic resin shell 18 and a synthetic resin skirt 20 as shown in FIG. 1. Tub 12 also includes hydropneumatic circulation system 22, a wooden frame 24, expandable synthetic resin foam insulation 26 and a flexible web barrier 28. The shell 18 is preferably molded of ROVEL TM synthetic resin material manufactured by the Dow Chemical Company, or a similar synthetic resin material, and presents a normally upper occupant receiving side 30 and a normally lower side 32 to which insulating foam 26 adheres. The shell is substantially circular in plan and suitably apertured to receive the various components of hydropneumatic circulation system 22 therethrough. In the preferred embodiment hereof, the shell is designed to hold approximately 220 gallons of water and to accommodate four adult occupants. During molding, about 5 narrow, spaced-apart ledges 34 are located at evenly spaced intervals around the side wall, as illustrated in FIG. 2. Ledges 34 are approximately ½ inch in width and located about 3¼ inch from the top rim 36 of the shell for ensuring positive support of the cover 16 thereon.

Foam insulation 26 is preferably of polyurethane which is sprayed in two components in liquid form and expands by virtue of the thermal reaction between the sprayed components. Urethane foam useful in accordance with the present invention may be purchased from Burton Urethane Corp. of Santa Ana, California under the product designation Bar 1500, "A" component and "B" component. When applied by spraying, the two components of the foam insulation 26 combine and thermally react to expand to approximately 10 times its original volume. The foam insulation occupies the area between normally lower side 32 of shell 18 and flexible web barrier 28. The foam insulation 26 adheres to both shell 18 and flexible web barrier, as well as frame 24 so as to hold the shell 18 to the frame 24 without the need for additional fastening means.

Figure 3:
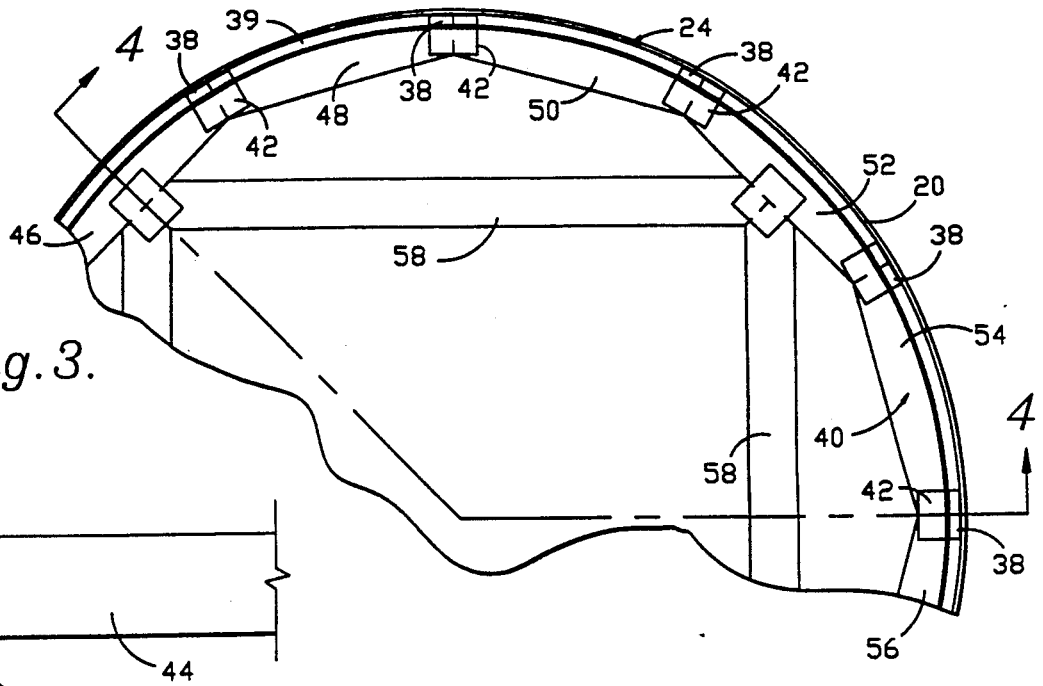
FIG. 3 is a fragmentary top plan view of the tub construction hereof prior to installation of the shell of the tub and application of the insulation foam, showing the wooden frame and sidewall construction.
Figure 4:
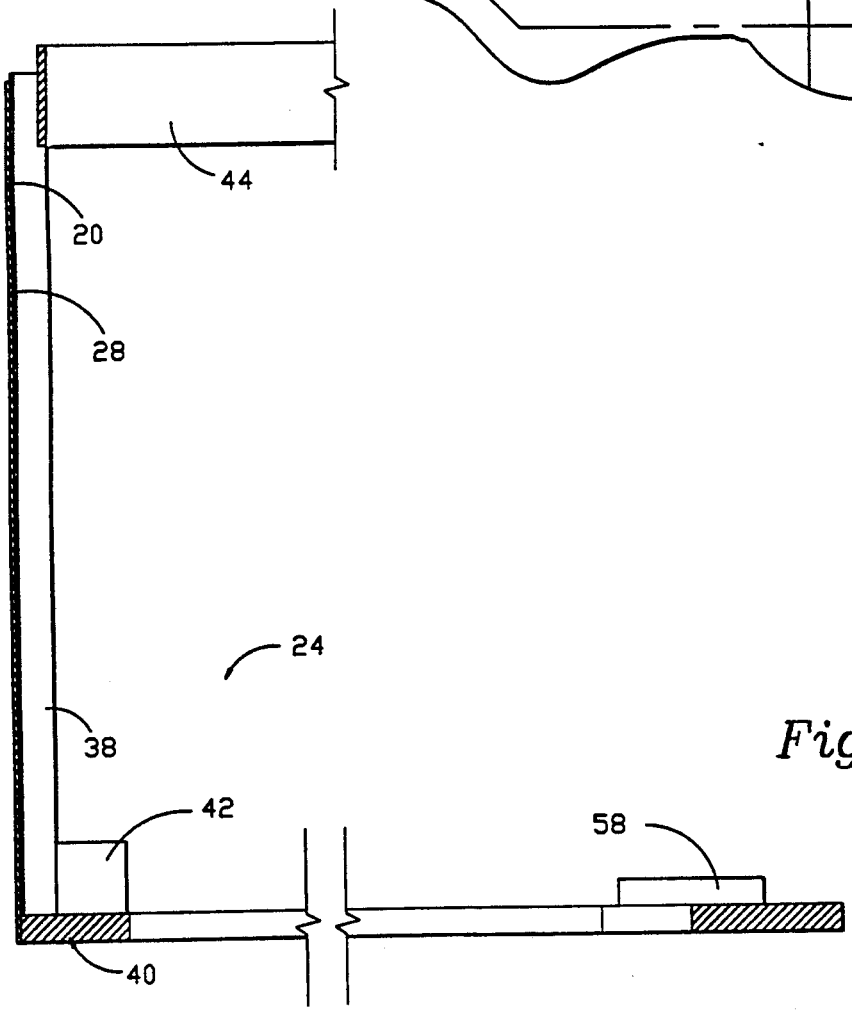
FIG. 4 is a fragmentary vertical cross-sectional view taken along line 4—4 of FIG. 3, showing the skirting and web barrier circumscribing the wooden frame of the tub.
Figure 7:
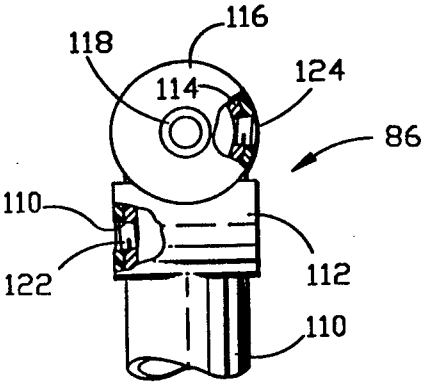
FIG. 7 is a rear elevational view of the fluid passageway hereof with portions broken away and shown in section.

Referring now to FIGS. 3 and 4, a wooden frame 24 includes a plurality of evenly spaced, normally upright supports 38 nailed to a surrounding base 40 and further joined thereto by sill 42. Frame 24 presents openings 39 between each of the supports. A top wall 44, preferably of Masonite ® is attached to the upright supports 38 at the inside upper margin thereof, as shown in FIG. 4. The Masonite ® wall is joined to the supports 38 so as to extend in a circumferentially spanning band and extends just above the supports 38 as shown in FIGS. 2 and 4. Base 40 comprises a number of chordal sections 46, 48, 50, 52, 54, 56 and so on as FIG. 3 represents only a fragmentary section of the frame 24, but it is to be understood that such chordal sections extend completely around the circular frame 24. Base 40 is further supported by beams 58 which serve to interconnect some of the chordal sections and provided rigidity to the frame 24.

Flexible web barrier 28 is wrapped circumferentially around the frame 24 and joined in end-to-end fashion thereby enclosing the openings 39. Web barrier 28 is preferably made of 60 pound brown paper available from Mead Paper Company or Stone Container Corp. This particular weight of paper has been found to provide sufficient stiffness to stand on edge during assembly of the tub, while remaining flexible enough to wrinkle with the foam insulation 26 when it shrinks during curing. The flexible web barrier 28 is not secured to the frame 24, but merely wrapped therearound, thereby permitting the barrier to yield during shrinkage of the foam insulation during curing of the latter.

The skirt 20 is preferably a single sheet of 0.060 thick ROVEL TM synthetic resin, although polyvinyl chloride or other synthetic resin material could be substituted. The synthetic resin sheet is circumferentially wrapped around the flexible web barrier 28 and joined to itself by a lap joint using a chemical solvent such as acetone or the like. Thus, the skirt is "welded" to itself in tight-fitting relationship around the flexible web barrier 28 and no additional fasteners are required to hold it in position. This presents a smooth and even appearance desirable for the exterior of the tub 12. After installation of the hydropneumatic circulation system 22 and application of the foam insulation 26, the excess foam is removed and a bottom 59 of a 0.050 inch thick sheet of ABS plastic is applied by gluing to the bottom of the frame to isolate the wooden frame and insulation from contact with any water which may have spilled over the edge of the tub 12.

The hydropneumatic circulation system 22 includes spaced-apart hydrotherapy jets 60, preferably obtained from Hydro-Air of Orange, Calif. under the part designation 16-42001, 16-52151, 10-5847110-4505. The jets 60 are fluidically connected by air conduit 62 and pressurized water conduit 64, each of flexible polyvinyl chloride which extend substantially circumferentially around the tub between the shell 18 and the skirt 20 and are surrounded by foam insulation 26 as shown in FIG. 2. Pressurized water conduit 64 in fact extends entirely around the tub, with conduit 64 joined to bullhead T 66 at both ends of the former. Bullhead T 66 is in turn connected to tub inlet union 68 for receiving pressurized water from power unit 14 and circulating the water through pressurized water conduit 64 and out through jet 60. As water is expelled from jet 60, air is aspirated into an air control 70 obtained from Hydro-Air as parts number 110-2190. Air conduit 62 is plugged after passing through the last of the four jets 60 in the preferred embodiment, whereby air is drawn into jets 60 only through air control 70.

Hydropneumatic circulation system 22 also includes means for returning water from the tub to the power unit 14. A filter canister 72 is located within filter housing 74 as shown in FIG. 2. Filter canister 72 is fluidically coupled to outlet T 76 by conduit and elbows, as shown, preferably made of PVC. In the event filter 72 becomes clogged or is otherwise inoperable, an extended wall nut 78 available from Hydro-Air as part number 10-6903 is oriented to receive water within filter housing 74 and transmit that water into outlet T 76. Outlet T 76 in turn is connected to tub outlet union 80 for returning water to power unit 14.

Figure 5:
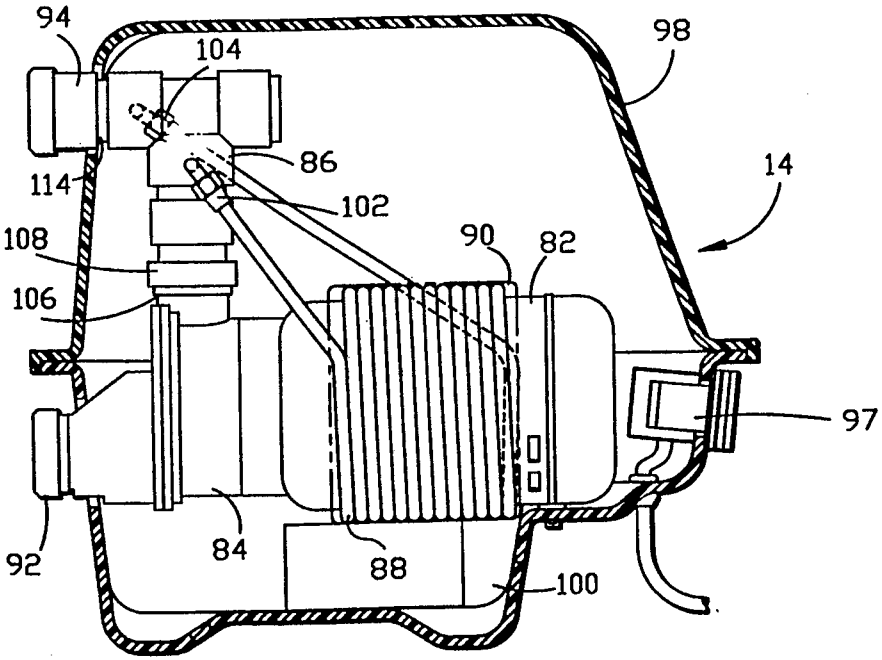
FIG. 5 is an enlarged side elevational view of the power unit of the present invention with the protective case shown in cross-section and portions of the heat recovery element shown in phantom.
Figure 6:
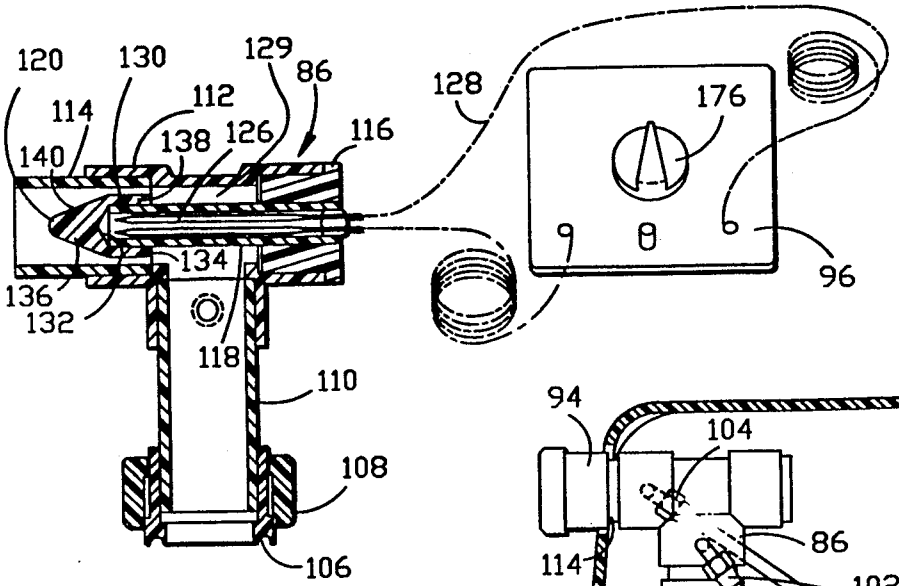
FIG. 6 is an enlarged cross sectional view through the outlet of the flow generating unit showing the fluid passageway for generating heat and including the constriction member and temperature sensor schematically connected to a temperature regulator mounted on the power unit.

Referring now to FIG. 5, power unit 14 of the spa 10 hereof broadly includes motor 82, pump 84, fluid passageway 86, scavenging coil 88, reflector 90, pump inlet 92, pressurized water outlet 94, thermostatic controls 96 (shown in FIG. 6) and protective case 98. Motor 82 is a one horsepower electric motor available from Emerson Electric of St. Louis, Mo. which is designed to operate on standard household 110-volt, single-phase, 15 ampere current. Motor 82 is protected by a ground-fault circuit interrupter 97 available from Arrow Hart Company of Hartford, Conn. as Part No. GF 2091, rated at 20 amperes and available from most electrical supply houses. The ground fault circuit interrupter provides added protection against electric shock.

Pump 84 is mechanically driven by motor 82, and is available from ITT Corporation under the Gemini model designation. A support block 100 helps support the motor and serves as an air separator so that the motor can draw cooling air into the motor and discharge such air back out through the protective case 98.

Scavenging coil 88 is preferably provided of synthetic resin material such as nylon 611, and in the preferred embodiment hereof, tubing comprising the coil 88 is obtained from Total Plastics of Kalamazoo, Mich. under the designation Nylaflow, as type LP611 with a $\frac{3}{8}$ inch inside diameter and a 0.040 inch wall thickness. As shown in FIG. 5, coil 88 is wrapped circumferentially around motor 82 and is connected to fluid passageway 86 by intake fitting 102 and outflow fitting 104, shown in phantom. The use of nylon tubing enables the coil 88 to conform closely to the motor 82 and thereby provides improved heat transfer to the coil over conventional metallic coils.

Pump 84 is connected to fluid passageway 86 at pump outlet 106 by collar 108. Fluid passageway 86 is shown in greater detail in FIG. 6 and includes high-pressure tube 110, T connector 112, constriction zone tubing 114, plug 116, dry well tube 118 and constriction member 120. High-pressure tube 110 and T connector 112 are perforated to provide an aperture 122 for receiving intake fitting 102, while constriction zone tubing 114 and T connector 112 are perforated to provide an opening 124 for receiving outflow fitting 104 of coil 88. Dry well tube 118 is open at both ends thereof to receive a thermistor 126 which is electrically coupled by wiring 128 to thermostatic controls 96, both available from Len Gordon Co. of San Fernando, Calif., and mounted on the portion of protective case 98 not shown in FIG. 5. The thermostatic controls include a printed circuit board also available from Len Gordon Co. A power cord and ground fault interrupter are electronically connected to the thermostatic controls for interrupting the current to the motor 82. The thermistor serves to measure the temperature of the water in the region 129 defined between the dry well tube 118 and the T connector 112 and transmits a signal to the thermostatic controls whereby the operation of the motor 82 and thus the pump 84 is responsive to the temperature sensed by the thermistor 126. Plug 116 serves to enclose T connector 112 opposite constriction zone tubing 114 and prevent the escape of water therefrom, as well as preventing water from entering into the interior of dry well tube 118.

Constriction member 120 receives dry well tube 118 therein into recess 132 thereof. The constriction member 120 presents an upstream end 134 having a greater outside diameter than downstream end 136, and presents a shoulder 138 of generally constant diameter adjacent the upstream end and a tapered surface 140 extending downstream from shoulder 138 to downstream end 136. Flow path 130 is defined between constriction member 120 and constriction zone tubing 114 and is generally annular in the preferred embodiment, although it is to be understood that other shapes than circular in cross-section for the constriction member 120 or constriction zone tubing 114, or the provision of a support for the constriction member by the surrounding constriction zone tubing, are intended to define a flow path falling within the definition of "generally annular".

Cover 16 is preferably circular in plan to fit within surrounding top rim 36 of shell 18 as shown in FIGS. 1 and 2. Cover 16 includes a first section 142 and a second section 144, each have a core of rigid synthetic foam such as polystyrene. First section 142 presents a peripheral arcuate edge wall 146 and a substantially linear connecting edge wall 148. Arcuate edge wall 146 is bevelled downwardly and inwardly from a top surface 150 thereof to a bottom surface 152 thereof in complimentary size and configuration to a section of the angled sidewall 154 of upper side 30 of shell 18. A rigid polystyrene core 155 is covered with a water-resistent vinyl covering 156 provided with a zipper 153 extending normally horizontally along the connecting edge wall 148 and extending slightly therebeyond into arcuate edge wall 146 to permit the rigid polystyrene core 155 to be easily removed.

Similarly, second section 144, which is somewhat smaller in plan than first section 142, presents a peripheral arcuate edge wall 157 which is slightly beveled downwardly and inwardly from a top surface 158 thereof to a bottom surface 160 thereof and is complimentarily sized and configured to a portion of the angled sidewall 154. Second section also includes a substantially linear connecting edge wall 162 located in opposition to connecting edge wall 148 of first section 142. The second section includes a water-resistant vinyl covering 164 provided with a zipper extending normally horizontally along the connecting edge wall 162 and slightly therebeyond into arcuate edge wall 157 to permit removal and insertion of the rigid polystyrene foam core 166 located therewithin. In addition, a resilient foam flap 168 is joined to the arcuate edge wall 157 for positioning over air control 70 to effect an air seal over the latter and conform thereto.

First section 142 and second section 144 are joined along their respective connecting edge walls 148 and 162 by sewing of the covers together along a bead 170. The sewn bead 170 thereby defines a hinge between first section 142 and second section 144 whereby a user may grasp loop 172 to shift second section 144 in a folding manner onto top surface 156 to permit access and use of the spa 10 by a single bather while the first section 142 remains in place for insulative purposes. A second loop 174 is attached to first section 142 for use when the entire cover 16 is to be removed.

In operation, a dial 176 on temperature control 96 is positioned at or just below the desired operating temperature, for example 101 degrees Fahrenheit when the user wishes to use the spa 10 at 102 degrees Fahrenheit. Assuming that the power unit 14 is connected to a power source such as a conventional electrical outlet and the water temperature is below 101 degrees Fahrenheit, the temperature control 96 signals motor 82 to begin operation. Motor 82 is in turn connected to pump 84 which begins circulating water within the spa. The water within the tub 12 leaves the tub 12 through tub outlet union 80 and enters pump inlet 92.

When the water passes through pump inlet 92 and is impelled by the impeller of pump 84, the water passes through pump outlet 106 and enters high-pressure tube 110 at an increased pressure relative to the pressure of the water entering pump inlet 92. A portion of the now pressurized water enters intake fitting 102 and is circulated through coil 88 whereby heat generated by the motor is transferred into the water circulating in the coil 88. The remainder of the water impelled by pump 84 passes through high-pressure tube 110 and flows through flow path 130.

As the water encounters upstream end 134, substantial turbulence is generated and corresponding friction between shoulder 138 and constriction zone tubing 114. The portion of the flow path between shoulder 138 and constriction zone tubing 114 defines a venturi creating a low-pressure area which enhances circulation of water through coil 88. The water circulating through the coil is thus reintroduced through opening 124 which is located opposite shoulder 138 of constriction member 120. Tapered surface 140 enhances the venturi effect, and it is important to note that the tapered surface 140 is located on the downstream side of constriction member 120 relative to shoulder 138. Thus, the constriction member 120 hereof is configured to present an abrupt upstream end 134 for generating turbulence, while tapered surface 140 is located downstream thereof for enhancing the venturi effect to thereby draw water through coil 88 into flow path 130.

Turbulence in the water between the pump and the venturi produces, in effect, a more viscous medium within which the impeller of the pump must work, thus causing a greater heat gain than would be obtained with merely laminar flow in that area. The use of the present constriction member design has been found to provide about 18 pounds per square inch in pressure drop across the constriction member, whereas an untapered downstream surface yields 8 to 10 pounds per square inch pressure differential. Using both mechanisms for generating heat, plus the heat generated due to turbulence caused by the impeller of the pump, it was possible to raise the water temperature in the spa about 3° to 4° F. per hour throughout the range of normally available ambient water temperatures.

The fluid passageway design also enables the use of a drywall construction for monitoring the temperature of the water. During testing, it has been found that this location and method for monitoring the water temperature not only electrically isolates the temperature monitoring unit from the water, thereby enabling the use of mineralized water in the spa 10, but also the sense temperature remains within 1° F. degree of the actual water temperature in the tub 12.

The tub 12 is constructed by first providing a frame 24 and shell 18. Shell 18 is molded by conventional vacuum molding techniques and allowed to cool so that it is relatively rigid, while frame 24 is nailed and/or glued together for receiving the shell thereon. Flexible web barrier 28 is wrapped in circumscribing relationship around the upright supports 38 of the frame 24 and not attached thereto, but rather connected to itself in end-to-end relationship. Thereafter, skirt 20 is wrapped in circumscribing relationship over the flexible web barrier 28 whereby the interior side of the skirt 20 is substantially isolated from the frame. It should be noted that the upright supports are substantially spaced-apart to define a number of openings therebetween, thus presenting access to the web barrier 28 from the inside of the frame.

Thereafter, the shell is received and placed but not secured onto the frame which carries the web barrier 28 and the skirt 20 therearound. The frame and shell 18 are then inverted whereby the normally lower side 32 is pointing up and exposed. The various components of the hydropneumatic circulation system 22 are then installed at corresponding openings in the shell 18, and the tub 12 is then ready to receive the foam insulation 26 between the lower side 32 of the shell 18 and the flexible web barrier 28. By spraying expandable polyurethane foam between the shell 18 and flexible web barrier 28, the under side of the tub 12 is thereby insulated and the foam insulation 26 additionally adheres to the lower side 32 of the skirt 20, the exposed members of the wooden frame 24, and the flexible web barrier 28. The insulating foam therefore acts as an adhesive to attach and secure the shell 18 to the frame 24 and the skirt 20 at the top and bottom of the skirt only, leaving the inside surface of the skirt 20 isolated from the adhesive foam by the flexible web barrier.

During spraying of the foam insulation 26, the two components of the polyurethane foam are combined and a thermal reaction causes the foam to expand and harden. This creates a series of gas pockets of voids which serve to insulate the tub 12 and to occupy most regions between the shell 18 and the frame 24. The expandable foam contracts slightly during curing as the foam cools. Because the foam adheres to the flexible web barrier 28, the flexible web barrier 28 is able to yield and to isolate the skirt 20 therefrom. Thus, it is the flexible web barrier 28 which wrinkles during curing of the foam, preventing distortion of the surrounding skirt 20. After the foam insulation 26 has cured, the excess is removed and an ABS plastic bottom 59 is installed. The tub 12 may then be righted whereby the upper side 30 is repositioned for normal use as shown in FIG. 2.

It may be appreciated that the power unit 14, the tub 12 and the cover 16 are all independent components which may be carried separately. Advantageously, the cover 16 is positioned as shown in FIG. 1 whereby connecting walls 148 and 162 of first section 142 and second section 144 are aligned so that flap 168 is positioned over air control 70. If only one occupant desires to use the spa 10, second section 144 is simply folded transversely to bead 170 while first section 142 remains securely in place in insulative covering relationship to the water within the tub 12. Heat loss to the atmosphere is thus minimized and economies of operation improve when only a single occupant desires to utilize the spa 10. Obviously, when the entire spa is to be used, the cover 16 would be removed in its entirety.

The design of the spa 10 hereof which includes the recovering of normally wasted heat from the 1 h.p. motor 82 and using only the addition of the frictional heat generated by the pumping action allows the spa 10 hereof to operate for only 25 to 35% of the energy costs of conventional spas that use electric heating elements. For example, where the ambient temperature is about 50° F., the normal operational cost of a conventional spa of the size hereof (capacity about 220 gallons) which use electric resistance heating elements is about $20.00 to $25.00 per month where electric energy costs $0.08 per kwh, whereas the present spa 10 costs only about $5.00 to $6.00 per month at the same electricity rate, and is always hot and ready to use.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. In a spa having a tub, a recirculation line for taking water out of the tub at one location and returning it to the tub at another location, an impeller coupled in flow communication with the line for effecting recirculation of water through the tub and the line, and a motor operably coupled with the impeller for driving the same, improved means for heating the water as it flows through the recirculation line comprising:

a venturi located within said recirculation line downstream from the impeller for creating separate regions of relatively high and low pressure within the line as water flows past the venturi;

a tubular heat exchange coil wrapped around said motor for drawing heat from the motor and transferring it to water in the recirculation line during operation of the motor, said coil having an inlet coupled in flow communication with the recirculation line at said high pressure region and an outlet coupled in flow communication with the line at said low pressure region whereby to induce circulation of a heat exchanging flow of water through the coil during concurrent recirculating flow of water through the recirculation line; and temperature sensing and control means operably connected with said motor for energizing and deenergizing the motor in response to the sensed temperature of water in the spa, said venturi including a member supported centrally within a tubular section of said recirculation line in radially inwardly spaced relationship therewith to define a restricted, annular flow path around the member, said member having a flat, squared-off shoulder facing in the upstream direction and extending radially inwardly from said restricted flow path at the upstream end of the flow path for causing turbulent flow in the line between the impeller and the member for increasing heat gain in the water moving through the recirculation line.

2. In a spa as claimed in claim 1, said venturi member having a tapered, downstream end of reduced dimension for relieving pressure in the recirculation line as water moves past the member.

3. In a spa as claimed in claim 1, said recirculation line including a tubular elbow that presents a pair of angularly intersecting sections of the line, causing the water to change directions as it flows through the elbow, said venturi member being located within the downstream one of said pair of sections and being supported in such location by a tube extending across the interior intersection of the sections in coaxial alignment with said one section, said tube being fixed at one end to a wall portion of the elbow and at an opposite end to said venturi member, said temperature sensing and control means including temperature sensing structure housed within said tube.

4. In a spa as claimed in claim 3, said elbow being constructed from a straight tubular conduit, presenting said upstream section of the elbow, and a tubular tee head secured to the end of the straight conduit to present the downstream section of the elbow, said tee head having a pair of annular, axially aligned, opposite end portions on opposite sides of a central annular portion, one of said annular end portions of the tee head having a plug received therein which closes said one annular end portion of the tee head and defines said wall portion of the elbow that supports said tube, said tube projecting axially from the plug across the central portion of the tee head and into the opposite annular end portion of the tee head to carry said venturi member.

5. In a spa as claimed in claim 1, said region of low pressure being located within said restricted, annular flow path, said inlet of the heat exchange coil being connected with the recirculation line at said restricted, annular flow path.

6. In a spa as claimed in claim 1, said heat exchange coil being constructed of a synthetic resinous material to encourage the coil to conform to the surface configuration of the motor for maximizing the amount of surface contact between the coil and the motor.

* * * * *